US011380248B2

(12) United States Patent
Wu et al.

(10) Patent No.: US 11,380,248 B2
(45) **Date of Patent: *Jul. 5, 2022**

(54) DRIVING METHOD AND DRIVING DEVICE FOR DRIVING A SCAN-TYPE DISPLAY

(71) Applicant: MACROBLOCK, INC., Hsinchu (TW)

(72) Inventors: Yi-Ta Wu, Hsinchu (TW); Chun-Yi Li, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/205,897

(22) Filed: Mar. 18, 2021

(65) Prior Publication Data

US 2021/0304665 A1 Sep. 30, 2021

(30) Foreign Application Priority Data

Mar. 26, 2020 (TW) ..... 109110131
Dec. 14, 2020 (TW) ..... 109144111

(51) Int. Cl.
*G09G 3/32* (2016.01)

(52) U.S. Cl.
CPC ..... *G09G 3/32* (2013.01); *G09G 2310/0267* (2013.01); *G09G 2310/0286* (2013.01); *G09G 2310/08* (2013.01)

(58) Field of Classification Search
CPC ..... G09G 2310/0267; G09G 3/32; G09G 2310/0286; G09G 2310/08; G09G 2300/06; G09G 2310/0275; G09G 2320/0257; G09G 2310/0278; G09G 2320/064; G09G 2320/0646; G09G 3/3426
See application file for complete search history.

(56) References Cited

U.S. PATENT DOCUMENTS 6,057,820 A 5/2000 Irwin
8,120,599 B2 * 2/2012 Kang ..... G09G 5/003 345/204
10,395,586 B2 8/2019 Kim
(Continued)

FOREIGN PATENT DOCUMENTS

CN 1573880 A 2/2005
CN 1797118 A 7/2006
(Continued)

OTHER PUBLICATIONS

Taiwan Intellectual Property Office, "Search Report" and English translation thereof, issued in Taiwanese patent application No. 109110131 dated Oct. 30, 2020, document of 2 pages.
(Continued)

*Primary Examiner* — Muhammad N Edun
(74) *Attorney, Agent, or Firm* — Akerman LLP; Peter A. Chiabotti

(57) ABSTRACT

A driving method is to be implemented by a driver module, is adapted to drive a scan-type display, and includes steps of: receiving an image stream and a synchronization control (SC) signal from a control module; generating a drive output based on the SC signal, the image stream and a clock signal to drive the display such that the display emits light in a line scan manner; and generating an image refresh signal based on the SC signal and the drive output. The image refresh signal is related to refreshing of images on the display.

12 Claims, 3 Drawing Sheets

(56) References Cited

U.S. PATENT DOCUMENTS

| | | | | |
|---|---|---|---|---|
| 2001/0022572 | A1 | 9/2001 | Murade | |
| 2003/0122773 | A1* | 7/2003 | Washio | G09G 3/3648 345/103 |
| 2003/0179221 | A1 | 9/2003 | Nitta et al. | |
| 2005/0231449 | A1 | 10/2005 | Miyagawa | |
| 2009/0309855 | A1 | 12/2009 | Wang et al. | |
| 2011/0141004 | A1 | 6/2011 | Kwon et al. | |
| 2012/0188272 | A1 | 7/2012 | Wang et al. | |
| 2013/0114016 | A1 | 5/2013 | Lim et al. | |
| 2016/0012787 | A1* | 1/2016 | Takahashi | G09G 3/3622 345/209 |
| 2016/0063933 | A1* | 3/2016 | Kobayashi | G09G 3/3614 345/691 |
| 2016/0125800 | A1 | 5/2016 | Kim | |
| 2017/0038875 | A1 | 2/2017 | Lee | |
| 2018/0090080 | A1 | 3/2018 | Chen et al. | |
| 2018/0293927 | A1 | 10/2018 | Tang et al. | |
| 2019/0206329 | A1* | 7/2019 | Lee | G09G 3/3677 |
| 2019/0228729 | A1 | 7/2019 | Okamoto et al. | |
| 2019/0251914 | A1 | 8/2019 | Chen | |
| 2019/0362683 | A1 | 11/2019 | Ikeda et al. | |
| 2020/0090597 | A1 | 3/2020 | Chen et al. | |
| 2020/0090608 | A1 | 3/2020 | Calayir et al. | |
| 2021/0304668 | A1 | 9/2021 | Wu et al. | |
| 2021/0304690 | A1 | 9/2021 | Wu et al. | |

FOREIGN PATENT DOCUMENTS

| | | | |
|---|---|---|---|
| CN | 101154353 | A | 4/2008 |
| CN | 102148625 | A | 8/2011 |
| CN | 101436393 | B | 4/2012 |
| CN | 101202017 | B | 5/2012 |
| CN | 106652894 | B | 11/2018 |
| CN | 109192149 | A | 1/2019 |
| CN | 109523958 | A | 3/2019 |
| CN | 209070956 | U | 7/2019 |
| CN | 108550351 | B | 3/2020 |
| TW | 200846775 | A | 12/2008 |
| TW | I390490 | B | 3/2013 |
| TW | I393104 | B | 4/2013 |
| TW | I645392 | B | 12/2018 |
| TW | 201914360 | A | 4/2019 |
| TW | 201935454 | A | 9/2019 |
| TW | I672686 | B | 9/2019 |
| TW | I688945 | B | 3/2020 |

OTHER PUBLICATIONS

Search Report appended to an Office Action, which was issued to Taiwanese counterpart application No. 109110131 by the TIPO dated Oct. 30, 2020 with an English translation thereof.

Search Report appended to an Office Action and English translation thereof, which was issued in corresponding Taiwanese application No. 109144111 by the TIPO dated Sep. 17, 2021 with an English translation thereof.

Search Report appended to an Office Action and English translation thereof, which was issued in corresponding Taiwanese application No. 110104896 by the TIPO dated Sep. 27, 2021 with an English translation thereof.

Search Report appended to an Office Action and English translation thereof, which was issued in corresponding Taiwanese application No. 110104898 by the TIPO dated Nov. 24, 2021 with an English translation thereof.

Search Report appended to an Office Action and English translation thereof, which was issued to Taiwanese counterpart application No. 110104899 by the TIPO dated Sep. 27, 2021 with an English translation thereof.

Search Report appended to an Office Action and English translation thereof, which was issued in corresponding Taiwanese application No. 110104901 by the TIPO dated Sep. 28, 2021 with an English translation thereof.

Office Action issued in corresponding U.S. Appl. No. 17/211,437 dated Aug. 5, 2021.

Office Action issued in corresponding U.S. Appl. No. 17/211,396 dated Nov. 12, 2021.

Office Action issued in corresponding U.S. Appl. No. 17/211,419 dated Sep. 3, 2021.

Office Action issued in corresponding U.S. Appl. No. 17/211,467 dated Aug. 5, 2021.

Office Action issued in corresponding U.S. Appl. No. 17/211,474 dated Aug. 6, 2021.

Office Action issued in corresponding U.S. Appl. No. 17/211,419 dated Mar. 17, 2022.

Office Action issued in corresponding U.S. Appl. No. 17/211,450 dated Jan. 27, 2022.

* cited by examiner

DRIVING METHOD AND DRIVING DEVICE FOR DRIVING A SCAN-TYPE DISPLAY

CROSS-REFERENCE TO RELATED APPLICATION

This application claims priority of Taiwanese Patent Application Nos. 109110131 and 109144111, respectively filed on Mar. 26, 2020 and Dec. 14, 2020.

FIELD

The disclosure relates to display driving techniques, and more particularly to a driving method and a driving device for driving a scan-type display.

BACKGROUND

A conventional driving device for driving a scan-type display to show images includes a control module and a driver module. The driver module receives a synchronization control signal and an image stream from the control module. The image stream contains multiple pieces of image data that respectively correspond to multiple images or image frames to be shown by the scan-type display. The driver module drives the scan-type display based on the synchronization control signal and the image stream such that switching of a backlight module, which includes a light emitting diode (LED) array, of the scan-type display between a state where all LEDs are lit and a state where no LEDs are lit is related to the synchronization control signal, such that light emitted by the backlight module is modulated by a display module of the scan-type display to show the images or image frames represented by the image stream, and such that refreshing of images on the scan-type display is synchronous to the synchronization control signal. The synchronization control signal is a vertical synchronization signal, is periodic, and has a frequency of, for example, 60 Hz. Therefore, the scan-type display refreshes periodically, and a frame rate thereof is equal to the frequency of the synchronization control signal.

However, under a circumstance where the synchronization control signal is non-periodic and where the backlight module is a scanning backlight module that is triggered by the synchronization control signal and that emits light in a line scan manner, driving the display module in the aforesaid manner will result in image tearing or image interruption.

SUMMARY

Therefore, an object of the disclosure is to provide a driving method and a driving device for driving a scan-type display. The driving method and the driving device can alleviate the drawback of the prior art.

According to an aspect of the disclosure, the driving method is to be implemented by a driver module, and is adapted to drive a scan-type display. The driving method includes steps of: (A) receiving an image stream from a control module; (B) receiving a synchronization control signal from the control module; (C) generating a drive output based on the synchronization control signal, the image stream and a clock signal and outputting the drive output to the scan-type display, such that the scan-type display emits light in a line scan manner; and (D) generating an image refresh signal based on the synchronization control signal and the drive output. The image refresh signal is related to refreshing of images on the scan-type display.

According to another aspect of the disclosure, the driving device is adapted to drive a scan-type display that includes a backlight module and a display module. The driving device includes a control module and a driver module. The control module generates an image stream and a synchronization control signal. The driver module is adapted to be coupled to the backlight module and the display module, and is further coupled to the control module to receive the image stream and the synchronization control signal therefrom. The driver module generates a drive output based on the synchronization control signal, the image stream and a clock signal and outputs the drive output to the backlight module, such that the backlight module emits light in a line scan manner. The driver module generates an image refresh signal based on the synchronization control signal and the drive output. The image refresh signal is related to refreshing of images on the scan-type display.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
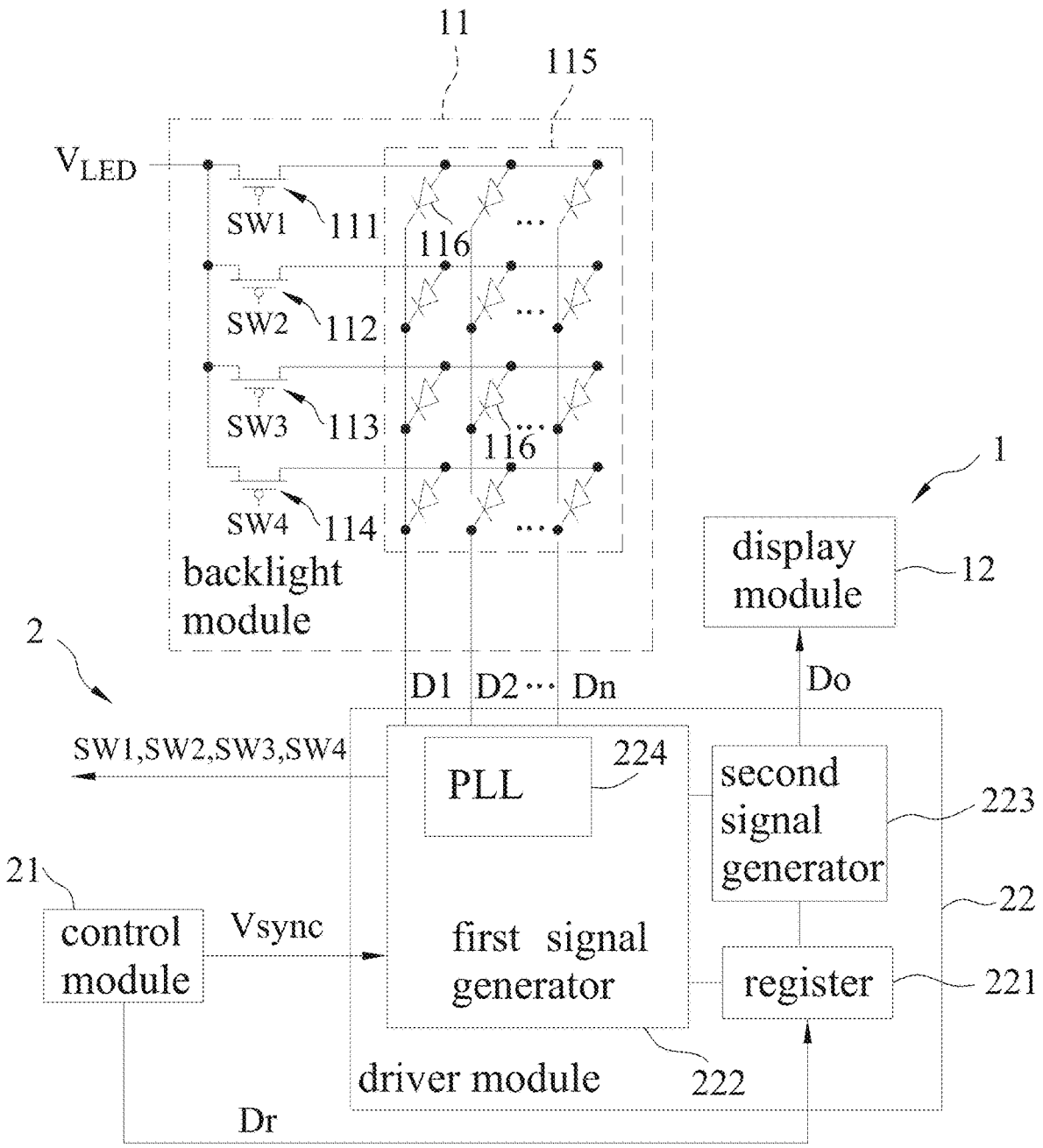
FIG. 1 is a circuit block diagram illustrating an embodiment of a driving device according to the disclosure in use with a scan-type display.
Figure 2:
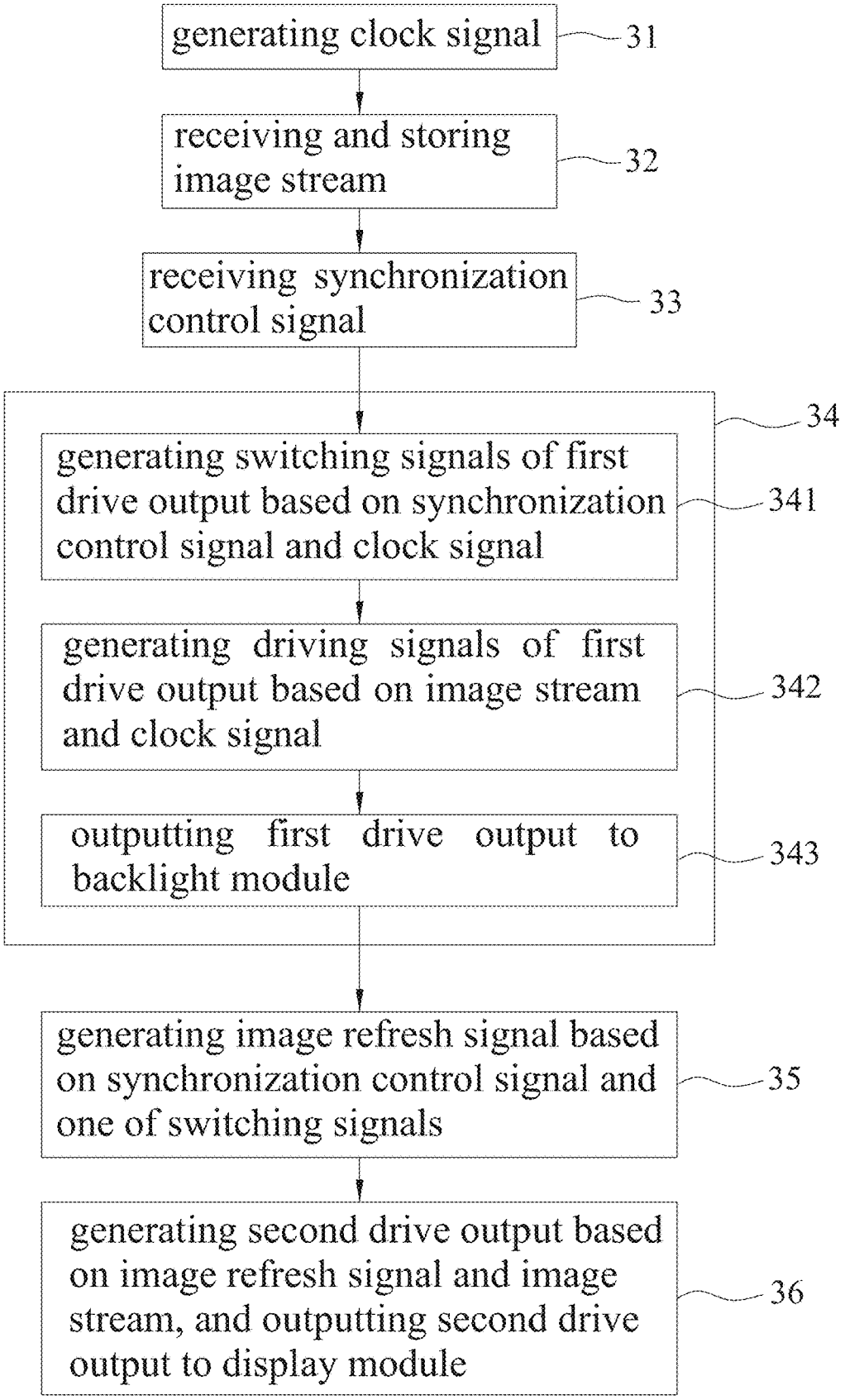
FIG. 2 is a flowchart illustrating a driving method performed by the embodiment.
Figure 3:
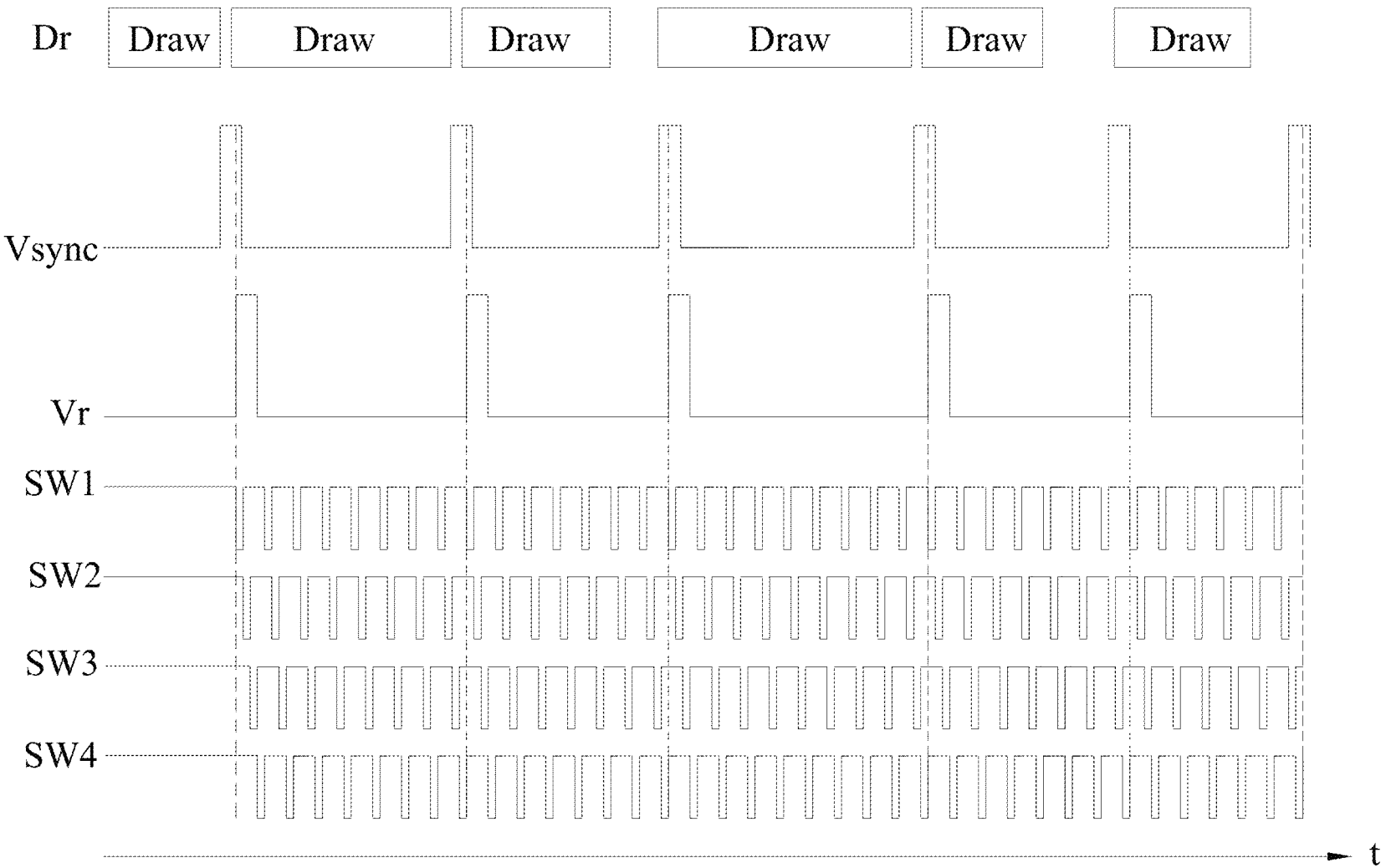
FIG. 3 is a timing diagram illustrating an image stream, a synchronization control signal, an image refresh signal and multiple switching signals of the embodiment.

Referring to FIGS. 1 to 3, an embodiment of a driving device 2 according to the disclosure is adapted to drive a scan-type display 1 to show images. The scan-type display 1 (e.g., a liquid crystal display (LCD)) supports dynamic frame rate technologies, and includes a backlight module 11 and a display module 12 (e.g., an LCD panel). The backlight module 11 includes a plurality of scan switches and a light emitting diode (LED) array 115. For illustration purposes, the backlight module 11 exemplarily includes four scan switches 111-114. Each of the scan switches 111-114 (e.g., a P-type metal oxide semiconductor field effect transistor (pMOSFET)) has a first terminal (e.g., a source terminal) that is to receive an input voltage ($V_{LED}$), a second terminal (e.g., a drain terminal) that is coupled to first terminals (e.g., anodes) of LEDs 116 in a respective row of the LED array 115, and a control terminal (e.g., a gate terminal). It should be noted that while the scan switches 111-114 are included in the backlight module 11 in this embodiment, they may be included in the driving device 2 or be independent of the scan-type display 1 and the driving device 2 in other embodiments.

The driving device 2 includes a control module 21 and a driver module 22.

The control module 21 generates a synchronization control signal (Vsync), and includes a graphic processing unit (GPU) (not shown) that generates an image stream (Dr). The image stream (Dr) contains multiple pieces of image data (Draw) that respectively correspond to multiple images or image frames to be shown by the scan-type display 1. In this embodiment, the control module 21 sequentially outputs the pieces of image data (Draw) to serve as the image stream (Dr). The driver module 22 is adapted to be coupled to the backlight module 11 and the display module 12, is further coupled to the control module 21 to receive the synchronization control signal (Vsync) and the image stream (Dr) therefrom, and drives the backlight module and the display module 12 based on the synchronization control signal (Vsync) and the image stream (Dr). In this embodiment, the driver module 22 includes a register 221, a first signal generator 222 and a second signal generator 223. The register 221 is coupled to the control module 21. The first signal generator 222 is adapted to be coupled to the control terminals of the scan switches 111-114 and second terminals (e.g., cathodes) of the LEDs 116 of the LED array 115, is further coupled to the control module 21 and the register 221, and includes a phase-locked loop (PLL) 224. The second signal generator 223 is adapted to be coupled to the display module 12, and is further coupled to the register 221 and the first signal generator 222. It should be noted that the second signal generator 223 includes a source driver and a gate driver, and is well known in the art, and therefore details thereof are omitted herein for the sake brevity. It should also be noted that the first and second signal generators 222, 223 may be fabricated on a single chip or on two separate chips.

In this embodiment, a driving method performed by the driver module 22 to drive the scan-type display 1 to show images includes the following steps 31-36.

In step 31, the PLL 224 generates a clock signal.

In step 32, the register 221 receives the image stream (Dr) from the control module 21, and stores the image stream (Dr).

In step 33, the first signal generator 222 receives the synchronization control signal (Vsync) and the image stream (Dr) respectively from the control module 21 and the register 221.

In step 34, the first signal generator 222 generates a first drive output based on the synchronization control signal (Vsync), the image stream (Dr) and the clock signal and outputs the first drive output to the backlight module 11, such that the backlight module 11 emits light in a line scan manner (i.e., light emitted in lines). In this embodiment, the first drive output includes a plurality of switching signals (e.g., four switching signals (SW1-SW4)) and a plurality of driving signals (D1-Dn), and step 34 includes the following sub-steps 341-343.

In sub-step 341, the first signal generator 222 generates the switching signals (SW1-SW4) based on the synchronization control signal (Vsync) and the clock signal. In this embodiment, each of the switching signals (SW1-SW4) is a pulse signal, and has a pulse width that is a multiple of a period of the clock signal; and in each line scan cycle of the backlight module 11, the pulses of the switching signals (SW1-SW4) are staggered and non-overlapping in time (i.e., the pulse of the switching signal (SW1), the pulse of the switching signal (SW2), the pulse of the switching signal (SW3) and the pulse of the switching signal (SW4) occur one by one without overlapping one another in time). In addition, transition of the switching signals (SW1-SW4) is triggered by the first pulse of the synchronization control signal.

In sub-step 342, the first signal generator 222 generates the driving signals (D1-Dn) based on the image stream (Dr) and the clock signal. In this embodiment, each of the driving signals (D1-Dn) is a pulse signal, and has a pulse width that is a multiple of the period of the clock signal, and the multiple varies according to the image stream (Dr).

In sub-step 343, the first signal generator 222 outputs the switching signals (SW1-SW4) and the driving signals (D1-Dn) to the backlight module 11. Each of the switching signals (SW1-SW4) is for receipt by the control terminal of a respective one of the scan switches 111-114. Each of the driving signals (D1-Dn) is for receipt by the second terminals of the LEDs 116 in a respective column of the LED array 115. Therefore, the scan switches 111-114 conduct one by one, and the LEDs 116 of the LED array 115 emit light row by row (i.e., the backlight module 11 emits light in the line scan manner). It should be noted that each row of the LED array 115 corresponds to a respective line of the line scan of the backlight module 11 (namely, a respective line of the backlight module 11 that emits light in each line scan cycle).

In step 35, the first signal generator 222 generates an image refresh signal (Vr) based on the synchronization control signal (Vsync) and the first drive output. The image refresh signal (Vr) is related to refreshing of images on the scan-type display 1 (i.e., an act of the scan-type display 1 switching from displaying a current image or image frame to displaying a next image or image frame).

In this embodiment, the first signal generator 222 generates the image refresh signal (Vr) based on the synchronization control signal (Vsync) and one of the switching signals (SW1-SW4) that corresponds to a last line of the line scan in each line scan cycle (i.e., the switching signal (SW4)). Each of the synchronization control signal (Vsync) and the image refresh signal (Vr) is a pulse signal. Each pulse of the image refresh signal (Vr), except the first pulse, lags a respective pulse of the synchronization control signal (Vsync), and a starting point thereof is concurrent with an end point of a pulse of said one of the switching signals (SW1-SW4) (i.e., the switching signal (SW4)) that occurs immediately after a starting point of the respective pulse of the synchronization control signal (Vsync).

In step 36, the second signal generator 223 receives the image stream (Dr) and the image refresh signal (Vr) respectively from the register 221 and the first signal generator 222, and generates a second drive output (Do) based on the image stream (Dr) and the image refresh signal (Vr) and outputs the second drive output (Do) to the display module 12, such that the scan-type display 1 shows images or image frames represented by the image stream (Dr) and that the refreshing of images on the scan-type display 1 is synchronous to the line scan. In this embodiment, light transmittance of the display module 12 varies according to the image stream (Dr), and light emitted by the backlight module 11 is modulated by the display module 12 to produce the images or image frames represented by the image stream (Dr).

It should be noted that, in this embodiment, step 31 is executed before execution of step 32. However, in other embodiments, step 31 may be executed after execution of step 32 and before execution of step 33, or may be executed after execution of step 33 and before execution of step 34. In other words, step 31 is executed before execution of step 34 regardless.

In view of the above, in this embodiment, by virtue of the second signal generator 223 generating the second drive output (Do) based on the image refresh signal (Vr), the refreshing of images on the scan-type display 1 can occur when the line scan cycle of the backlight module ends, thereby preventing image tearing or image interruption and attaining better display quality.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A driving method to be implemented by a driver module and adapted to drive a scan-type display that includes a backlight module and a display module, said driving method comprising steps of:

(A) receiving an image stream from a control module;

(B) receiving a synchronization control signal from the control module;

(C) generating a first drive output based on the synchronization control signal, the image stream and a clock signal and outputting the first drive output to the backlight module, such that the backlight module emits light in a line scan manner; and (D) generating an image refresh signal based on the synchronization control signal and the first drive output, the image refresh signal being related to refreshing of images on the scan-type display.

2. The driving method of claim 1, wherein:

the first drive output includes a plurality of switching signals; and in step (D), the image refresh signal is generated based on the synchronization control signal and one of the switching signals that corresponds to a last line of the line scan in each line scan cycle.

3. The driving method of claim 2, wherein:

each of the switching signals, the synchronization control signal and the image refresh signal is a pulse signal; and each pulse of the image refresh signal lags a respective pulse of the synchronization control signal, and a starting point thereof is concurrent with an end point of a pulse of said one of the switching signals that occurs immediately after a starting point of the respective pulse of the synchronization control signal.

4. The driving method of claim 1, further comprising a step of:

(F) generating the clock signal;

wherein step (F) is executed before execution of step (C).

5. The driving method of claim 1, wherein:

the first drive output includes a plurality of switching signals and a plurality of driving signals; and step (C) includes (C1) generating the switching signals based on the synchronization control signal and the clock signal, (C2) generating the driving signals based on the image stream and the clock signal, and (C3) outputting the switching signals and the driving signals to the backlight module.

6. The driving method of claim 1, further comprising a step of:

(E) generating a second drive output based on the image refresh signal and the image stream and outputting the second drive output to the display module, such that the scan-type display shows images represented by the image stream and that the refreshing of images on the scan-type display is synchronous to the line scan;

wherein step (E) is executed after execution of step (D).

7. A driving device adapted to drive a scan-type display that includes a backlight module and a display module, said driving device comprising:

a control module generating an image stream and a synchronization control signal; and a driver module adapted to be coupled to the backlight module and the display module, and further coupled to said control module to receive the image stream and the synchronization control signal therefrom;

said driver module generating a first drive output based on the synchronization control signal, the image stream and a clock signal and outputting the first drive output to the backlight module, such that the backlight module emits light in a line scan manner;

said driver module generating an image refresh signal based on the synchronization control signal and the first drive output, the image refresh signal being related to refreshing of images on the scan-type display.

8. The driving device of claim 7, wherein:

the first drive output includes a plurality of switching signals; and said driver module generates the image refresh signal based on the synchronization control signal and one of the switching signals that corresponds to a last line of the line scan in each line scan cycle.

9. The driving device of claim 8, wherein:

each of the switching signals, the synchronization control signal and the image refresh signal is a pulse signal; and each pulse of the image refresh signal lags a respective pulse of the synchronization control signal, and a starting point thereof is concurrent with an end point of a pulse of said one of the switching signals that occurs immediately after a starting point of the respective pulse of the synchronization control signal.

10. The driving device of claim 7, wherein:

said driver module generates a second drive output based on the image refresh signal and the image stream and outputs the second drive output to the display module, such that the scan- type display shows images represented by the image stream and that the refreshing of images on the scan-type display is synchronous to the line scan.

11. The driving device of claim 10, wherein said driver module includes:

a first signal generator adapted to be coupled to the backlight module, further coupled to said control module to receive the synchronization control signal therefrom, and disposed to further receive the image stream, said first signal generator including a phase-locked loop that generates the clock signal, said first signal generator generating the first drive output based on the synchronization control signal, the image stream and the clock signal, outputting the first drive output to the backlight module, and generating the image refresh signal based on the synchronization control signal and the first drive output; and a second signal generator adapted to be coupled to the display module, further coupled to said first signal generator to receive the image refresh signal therefrom, and disposed to further receive the image stream;

said second signal generator generating the second drive output based on the image refresh signal and the image stream, and outputting the second drive output to the display module.

12. The driving device of claim 11, wherein said driver module further includes:

a register coupled to said control module to receive the image stream therefrom, and storing the image stream;

said first and second signal generators being further coupled to said register to receive the image stream stored therein.

* * * * *